United States Patent [19]

Pasbol

[11] Patent Number: 4,912,804

[45] Date of Patent: Apr. 3, 1990

[54] MOP WRINGER

[75] Inventor: John C. Pasbol, Humlebaek, Denmark

[73] Assignee: Fr. Ditlevsens Eftr. A/S, Lynge, Denmark

[21] Appl. No.: 223,785

[22] PCT Filed: Jun. 13, 1988

[86] PCT No.: PCT/DK88/00093

§ 371 Date: Jul. 22, 1988

§ 102(e) Date: Jul. 22, 1988

[87] PCT Pub. No.: WO89/12419

PCT Pub. Date: Dec. 28, 1989

[51] Int. Cl.[4] ..... A47L 13/60

[52] U.S. Cl. ..... 15/262

[58] Field of Search ..... 15/262, 260; 68/244, 68/248, 253 R, 256

[56] References Cited

U.S. PATENT DOCUMENTS

| | | | |
|---|---|---|---|
| 1,541,886 | 5/1925 | Wolter | 15/262 |
| 1,823,486 | 9/1931 | Chase | 15/262 |
| 3,441,973 | 5/1969 | Turk | 15/262 |

*Primary Examiner*—Edward L. Roberts

*Attorney, Agent, or Firm*—Foley & Lardner

[57] ABSTRACT

A mop (12) is wrung by means of a mop wringer (10) comprising a housing (50), a pair of rotatable, wringing rollers (68, 70) having resilient roller bodies. At least one of the rollers (70) is movable between an inactive position, in which the rollers (70, 68) are out of contact with one another and in spaced apart relationship, and an active position in which the rollers (68, 70) are in contact with one another and further pressed against the mop (12). The movable roller (70) is moved from its inactive position by the interaction between an L-shaped arm (72), which is caused to swing by means of a handle (90), by means of an arm assembly (96) or by means of a motor (106). The L-shaped arm (72) interacts with a cam surface of a further L-shaped arm (74), on which the movable roller (70) is journalled. After the movable roller (70) has been brought into contact with and presses against the non-movable roller (68) and the mop (12), the movable roller (70) is maintained in its active position by means of a cam surface of the first mentioned L-shaped arm (72). The movable roller (70) is further caused to rotate by means of teeth of the first mentioned L-shaped arm (72), which teeth mesh with a toothed wheel of the movable roller (70).

19 Claims, 6 Drawing Sheets

MOP WRINGER

Figure 1:
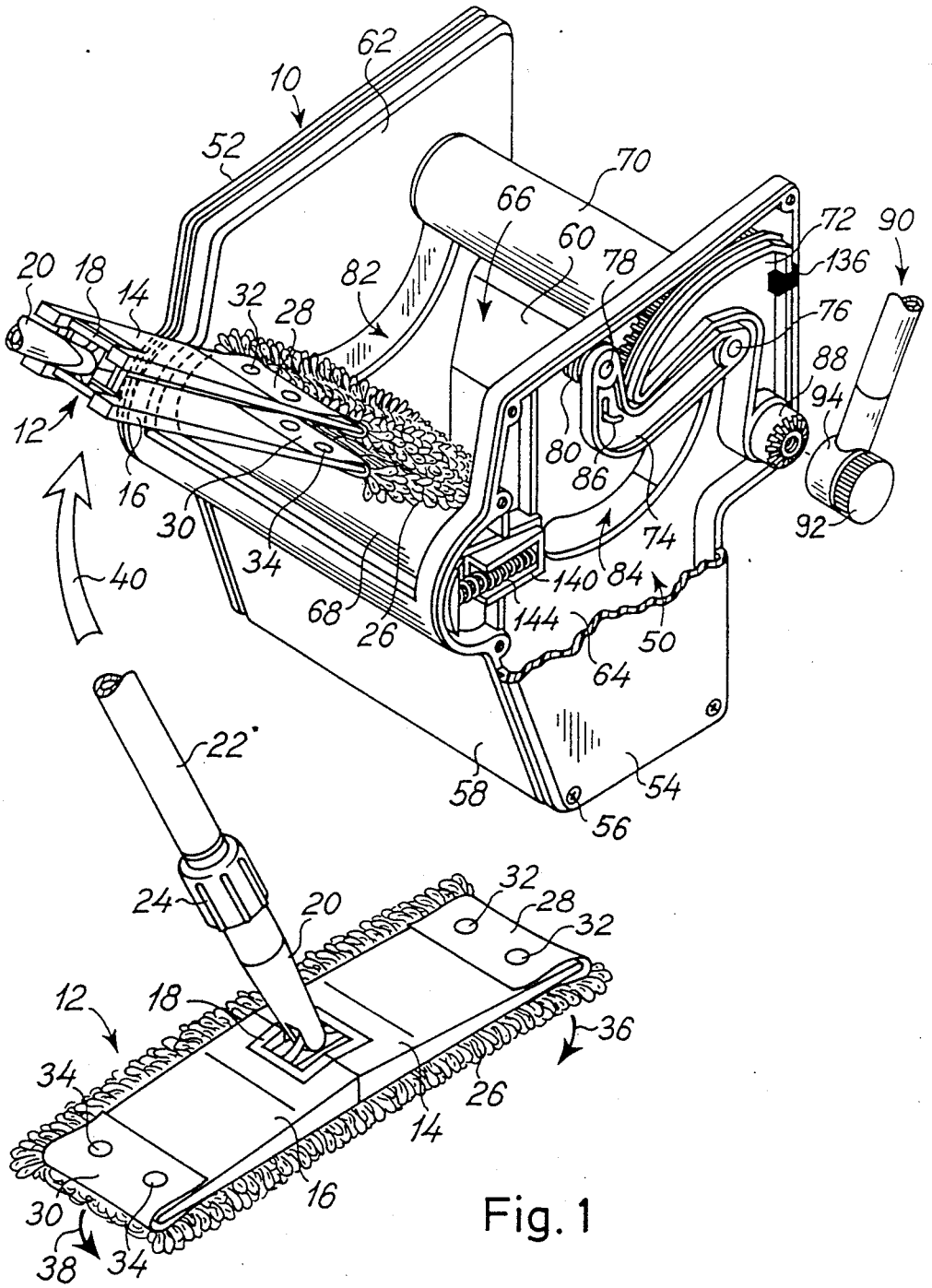

The present invention relates to the technical field of mop wringers.

Numerous mop wringers are known within the technique. Thus, reference is made to the following U.S. Pat. Nos. 688,613, 1,110,616, 1839,748, 2,099,217, 2,165,862, 2,299,777, 2,417,416, 2,544.937, and 3,441,973. Common to these known mop wringers are their inadequate and unsatisfactory operation. In the case of the known mop wringers, the squeezing pressure or wringing pressure is simply generated by the mechanical pressure, which an operator produces by means of a handle, which squeezing or wringing pressure is transmitted to a mop, which has previously been introduced into the mop wringer. Other technical solutions relate to the employment of springs for generating a pressure between mop squeezing or mop wringing rollers.

An object of the present invention is to provide a novel mop wringer, which makes it more easy for an operator to efficiently squeeze a mop, which has previously been introduced into the mop wringer, without having to generate an extremely high manual pressure. A further object of the present invention is to provide a mop wringer, which eliminates any risk of jamming of cooperating components of the mop wringer, such as cooperating teeth of toothed wheels and toothed racks of the prior art mop wringers.

As still further object of the present invention is to provide a durable and high-strength mop wringer.

An important feature of the present invention is the fact that the mop wringer may be made from a fairly small number of components. Other features, advantages and objects will be evident from the description below.

The above and other objects, features and advantages are obtained in accordance with the present invention by means of a mop wringer comprising:

a housing, a pair of rotatable, wringing rollers having resilient roller bodies, at least one of which rollers is movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a drive wheel for receiving rotational motion for causing said rollers to rotate in opposite directions when in said active position, and actuator means movable from a first position, through a second position and to a third position, and comprising a first and a second cam surface and a roller drive means, said first cam surface guiding said movable roller from said inactive position to said active position, when said actuator means is moved from said first position to said second position, said second cam surface locking said movable roller in said second position, when said actuator means is moved from said second position to said third position and vice versa, and said roller drive means transmitting rotational motion to said drive wheel, when said actuator means is moved from said second position to said third position and vice versa.

By the employment of an actuator means having a first and a second cam surface, the movable roller is smoothly moved from its inactive position to its active position and positively maintained in its active position while the roller, which is caused to rotate by the interaction between the drive wheel and the roller drive means, is caused to rotate. Thus, the roller drive means does not transmit any force to said drive wheel for maintaining the rollers in contact with one another and pressed against one another. The roller drive means transmits rotational power to the drive wheel exclusively.

In order to ensure that the movable roller is positively moved from its inactive position to its active position and further maintained in its active position while the rollers are rotated driven by the roller drive means, the housing of the mop wringer according to the present invention, preferably has rollers extending between opposite end walls and journalled at opposite ends of the rollers, and the movable actuator means preferably further comprises a pair of actuator means provided at respective opposite end walls and acting on said movable roller at opposite ends thereof.

In accordance with an embodiment of the mop wringer according to the present invention, both rollers of the pair of rollers are movable rollers actuated by the pair of actuator means for moving both rollers from their inactive positions into contact with one another in the active positions. Furthermore, in accordance with a further implementation of the above embodiment of the mop wringer according to the present invention, the rollers are moved in relation to the housing for generating the rotational motion to be transmitted to the drive wheels. In this and other embodiments of the mop wringer according to the present invention, the drive wheel or the drive wheels of the roller or rollers, respectively, are preferably a toothed wheel or wheels, respectively, and the roller drive means are preferably a toothed rack or racks, respectively. Alternatively, other drive means such as rubber drive wheels, rubber drive belts, etc., may be used in connection with the mop wringer according to the present invention.

In accordance with the presently preferred embodiment of the mop wringer according to the present invention, each of said pair of actuator means comprising a first arm means defining said first cam surface and a second arm means defining said second cam surface, said first arm means being journalled swingable at one end thereof in said housing, said movable roller being journalled in said first arm means at an opposite end of said first arm means, said second arm means being journalled swingable at one end thereof in a journalling bearing in said housing, said second arm means having an abutment means at an opposite end thereof for engagement with said firs cam surface, said second cam surface defining a segment of a circle having its centre at said journalling bearing, said second arm means being swingable from said first position to said second position for swinging said movable roller from its inactive position to its active position by the transmission of said swinging of said second arm means to a swinging of said first arm means through the engagement between said abutment means and said first cam surface, said second arm means being swingable from said second position to said third position, and said second cam surface engaging with said opposite end of said first arm means, when said second arm means is swinging from said second position to said third position.

In accordance with a further implementation of the above, presently preferred embodiment of the mop wringer according to the present invention, the toothed rack is arranged in parallel with said second cam surface so as to engage with said toothed means of said movable roller, when said second cam surface is in engagement with said opposite end of the first arm means.

In accordance with two alternative embodiments of the mop wringer according to the present invention, each of said pair of actuator means comprising a first swingable means having a first toothed wheel and a second swingable means having a second toothed wheel, said second swingable means comprising said toothed rack, said first and second toothed wheels meshing with one another for transmitting any swinging of any of said swingable means to the other and vice versa, said second swingable means defining said first and said second cam surfaces, said first swingable means being swingable from said first position, through said second position, and to said third position, said second cam surface of said second swingable means defining a segment of a circle having its centre at the centre of swinging of said second swingable means, the swinging of said first swingable means from said first position to said second position being transmitted to said second swingable means through said meshing toothed causing said first cam surface of said second swingable means to guide said movable roller from its inactive position to its active position, and the swinging of said first swingable means from said second position to said third position being transmitted to said second swingable means through said meshing toothed wheels causing said second cam surface to lock said movable roller in said active position and further causing said at least one roller to rotate by engagement between said toothed rack of said second swingable means and said toothed wheel of said at least one roller.

In accordance with a further embodiment of the mop wringer according to the present invention each of said pair of actuator means comprising a swingable plate means having an aperture defining said first and said second cam surfaces and further comprising said toothed rack, said swingable plate means being swingable from said first position, through said second position and further to said third position, said second cam surface defining a segment of a circle having its centre at the centre of swinging of said swingable plate means, the swinging of said swingable plate means from said first position to said second position causing said first cam surface to guide said movable roller from its inactive position to its active position, and the swinging of said plate means from said second position to said third position causing said second cam surface to lock said movable roller in said second position, and further causing said toothed rack to make said at least one roller rotate by its engagement with said toothed wheel.

In accordance with a still further embodiment of the mop wringer according to the present invention, each of said pair of actuator means comprising a reciprocating, movable guiding means defining said first and second cam surfaces and having said toothed rack, and further being movable from said first position, through said second position, and to said third position.

It is to be realized that the actuator means of the mop wringer according to the present invention may be moved in any appropriate manner, i.e. along a linear or circular path, in a swinging or rotational motion or combinations thereof.

It is further to be realized that the mop wringer may be operated by any appropriate means such as a motor, e.g. an electrical motor, a hydraulic or pneumatic motor, or preferably by means of a handle. Thus, the mop wringer preferably comprises a handle for moving the actuator means from the first position, through the second position and to the third position.

A particular aspect of the present invention relates to the roller or rollers of the mop wringer. Different rollers have been used with success in the mop wringer according to the present invention.

However, in the presently preferred embodiment of the mop wringer, at least one of the rollers is constituted by a roller having a foamed, resilient body of a resiliency of less than 80 Shore (A), such as 40–65 Shore (A), preferably 45–60 Shore (A), further preferably 50–55 Shore (A).

The present invention also relates to a mop wringing system comprising a mop wringer and a mop, said mop having:

a housing, a pair of rotatable, wringing rollers having resilient roller bodies, at least one of which rollers is movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a drive wheel for receiving rotational motion for causing said rollers to rotate in opposite directions when in said active position, and actuator means movable from a first position, through a second position and to a third position, and comprising a first and a second cam surface and a roller drive means, said first cam surface guiding said movable roller from said inactive position to said active position, when said actuator means is moved from said first position to said second position, said second cam surface locking said movable roller in said second position, when said actuator means is moved from said second position to said third position and vice versa, and said roller drive means transmitting rotational motion to said drive wheel, when said actuator means is moved from said second position to said third position and vice versa, and said mop having:

a mop body and two wing parts, which wing parts are hinged to one another at inner ends thereof, and said mop body being connected to said wing parts at outer opposite ends of said wing parts, said mop being collapsible by swinging said wing parts from an operational position, in which said wing parts define a substantially plane surface against which said mop body is maintained in a stretched-out position, and an inoperational position, in which said wing parts are collapsed so as to allow said mop body to suspend from said opposite ends of said wing parts for introducing said mop body into said mop wringer.

According to the this aspect of the present invention, the mop wringer according to the present invention is used in connection with a mop having two plane wing parts, which may be collapsed so as to provide a plane configuration rendering it more easy to introduce the mop into and squeeze it through the mop wringer.

As mentioned above, a particular aspect of the present invention relates to a roller comprising:

a central tube of a hard plastics material, a sheathing of a soft plastics material arranged coaxially with said central tube and enclosing said central tube and further having outwardly protruding fins, and a roller body of foamed material, which roller body defines an outer peripheral surface of said roller and is arranged enclosing said sheathing and coaxially with said central tube.

It is believed that the roller according to the present invention may be used in numerous technical fields, such as within the transportation field, as conveyors, as transportation wheels, in roller floors, roller skates, etc. The foamed body of the roller according to the present invention, which roller preferably constitutes at least one of the rollers of the mop wringer according to the present invention, is preferably made from foamed polyurethane foam.

Figures 1A, 1B, 1C:
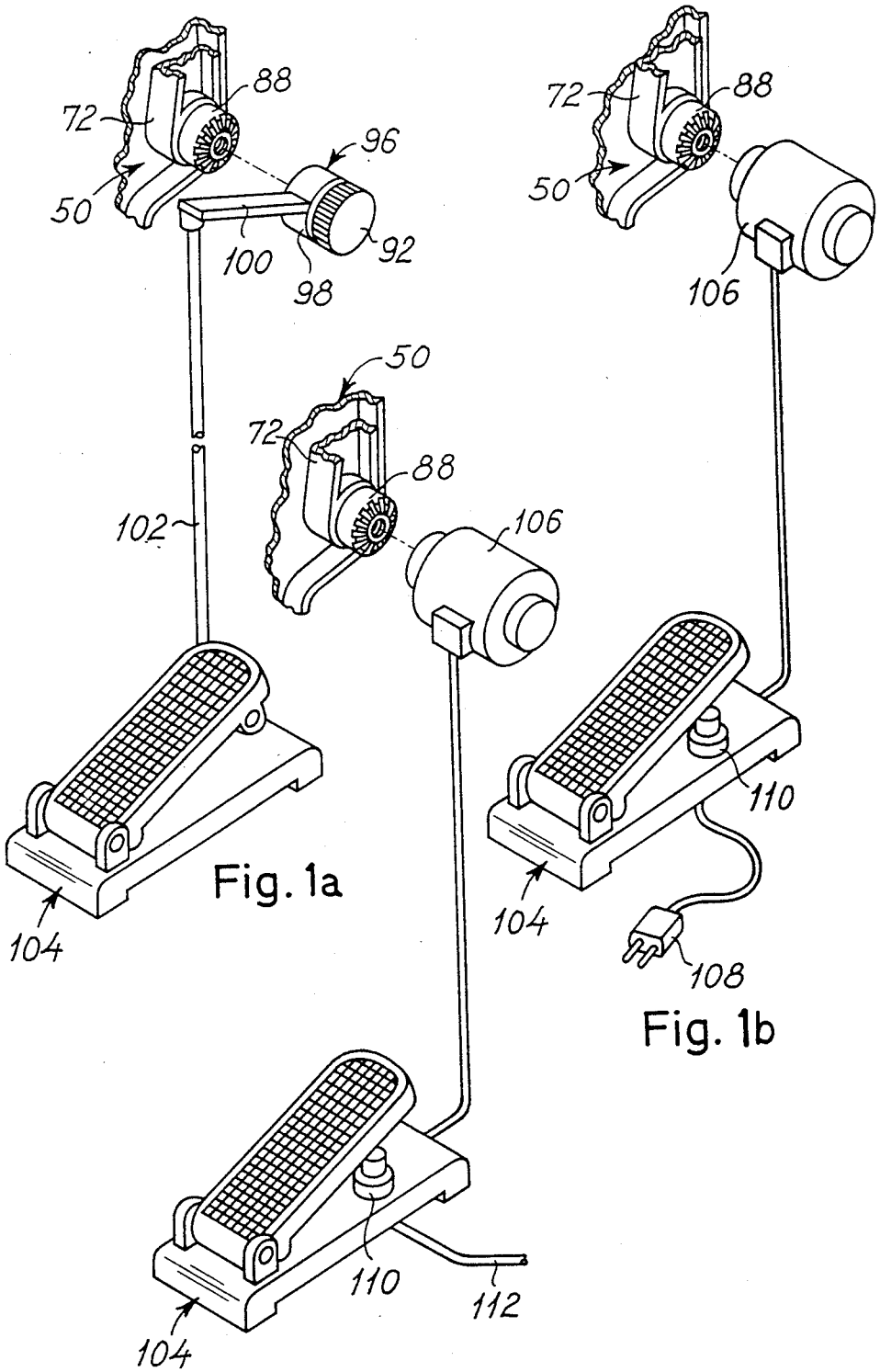
Figure 2:
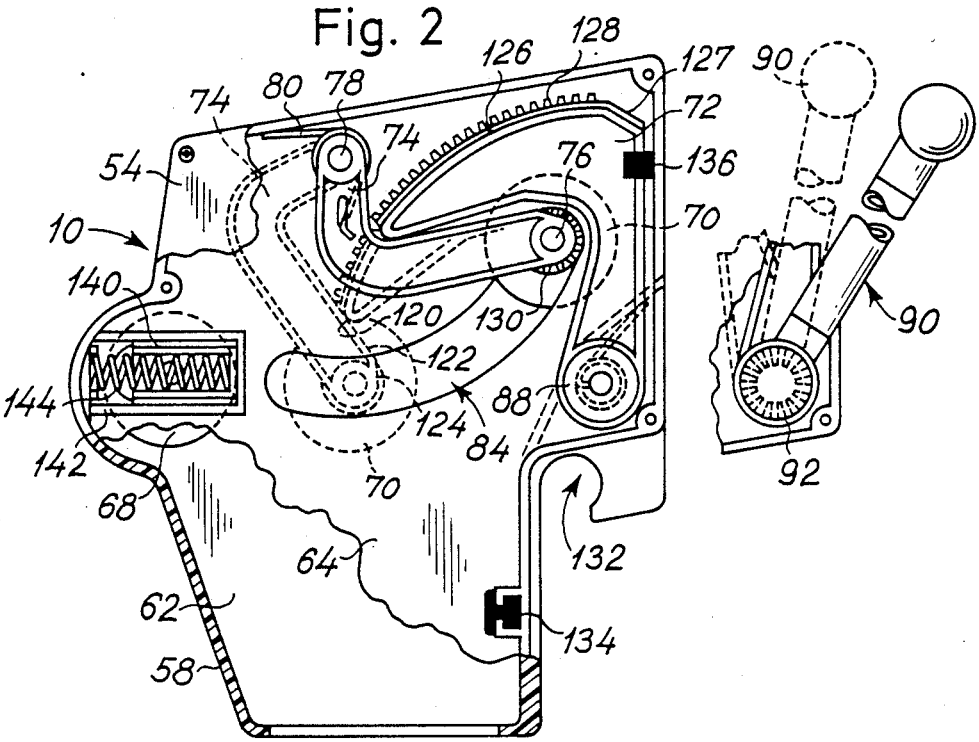
Figure 3:
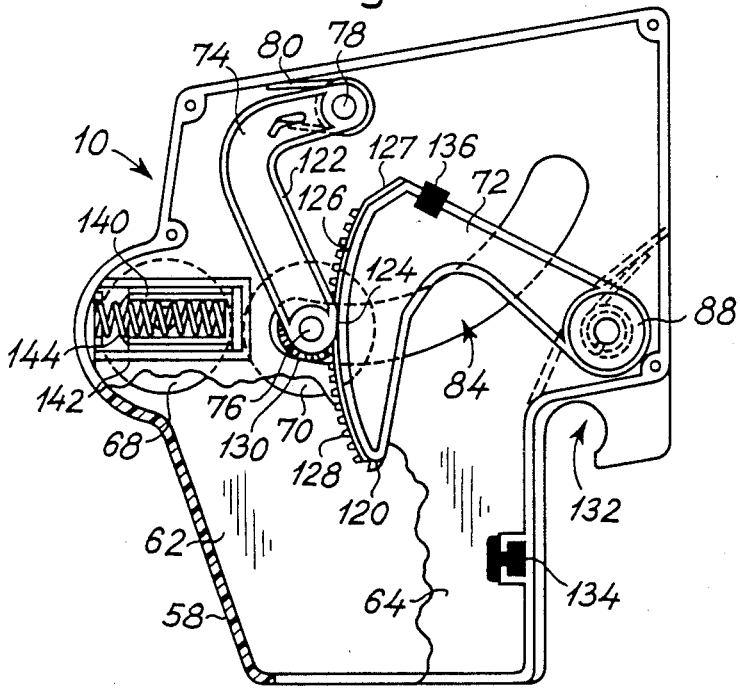
Figure 9:
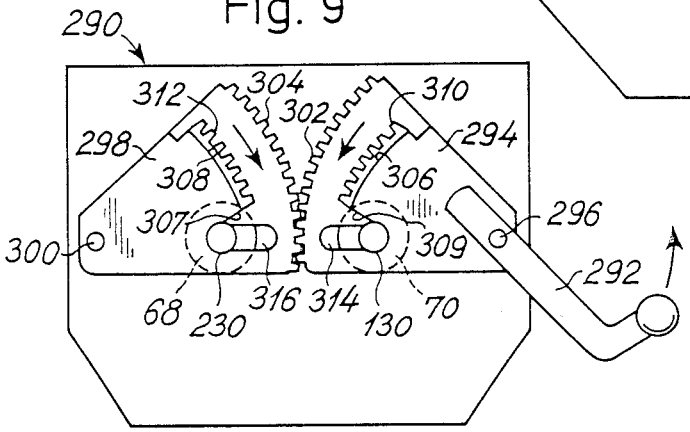
Figure 10:
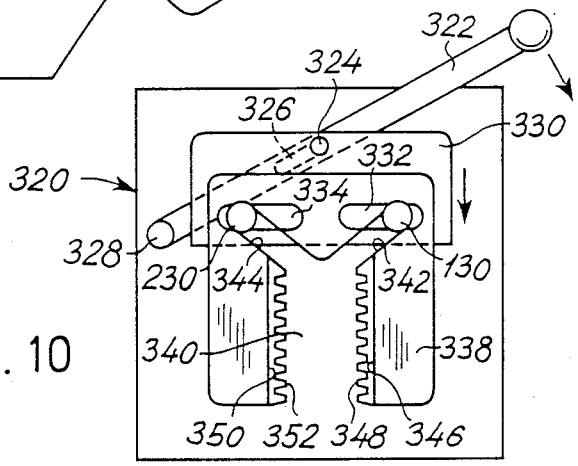
Figure 11:
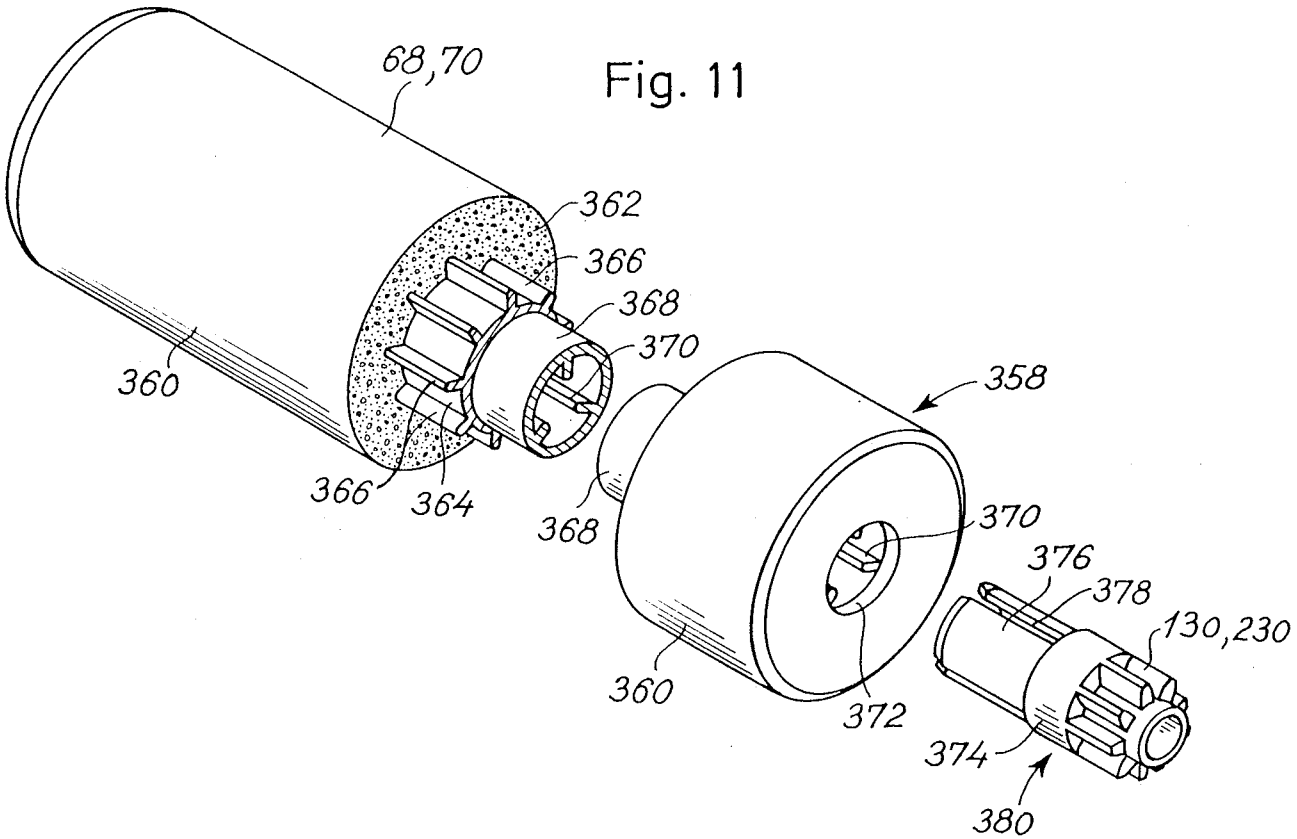

The present invention will now be further described with reference to the drawings, in which FIG. 1 is a perspective view of a first, FIGS. 1*a*, 1*b* and 1*c* are perspective views showing three modifications of the operating mechanisms for the mop wringer of the present invention, presently preferred embodiment of a mop wringer according to the present invention, a mop and a mop wringing system according to the present invention and comprising the mop wringer and the mop, FIG. 2 is a partial, sectional view of the first and presently preferred embodiment of the mop wringer according to the present invention shown in FIG. 1, shown in a first position in solid line and in a second position in dotted line, FIG. 3 is a partial, sectional view of the above first and presently preferred embodiment of the mop wringer according to the present invention shown in a third position, FIGS. 4–10 are schematic and sectional views of a second, third, fourth, fifth, sixth, seventh and eighth embodiment of a mop wringer, respectively, according to the present invention, and FIG. 11 is a perspective and partially sectional view of a wringer roller of the embodiments of the mop wringer shown in FIGS. 1–10, which roller constitutes a separate roller according to the present invention.

In FIG. 1, a mop squeezer or mop wringing system according to the present invention is shown comprising a mop squeezing apparatus or mop wringer and a mop 10 and 12, respectively. It is to be emphasized that the mop wringer according to the present invention and implemented in accordance with the embodiments to be described below with reference to FIGS. 1–10 is preferably employed in connection with the mop 12, however, the mop wringer according to the present invention may alternatively be used in connection with any conventional mop of any size and shape.

The mop 12 is of a collapsible structure as it comprises two wing parts 14 and 16, which are hinged to a hinge component 18, to which a tubular component 20 is further hinged in a two-way hinge, which allows the tubular component 20 to move or rotate relative to the hinge component 18 in a manner similar to a ball-and-socket joint. A handle 22 is fixed relative to the tubular component 20 by means of a screw cap joint 24. The wing parts 14 and 16 are maintained in a plane configuration shown in the lower part of FIG. 1 by means of snap fittings of each of the wing parts 14 and 16, which snap fittings cooperate with the hinge component 18. A mop body is fixed relative to the wing parts 14 and 16 by means of flaps 28 and 30 extending outwardly from opposite ends of the mop body 26, which flaps 28 and 30 are provided with fixation components such as snap fastener components 32 and 34, respectively, which snap fastener components 32 and 34 cooperate with corresponding components of the wing parts 14 and 16, respectively. By applying a physical force in the longitudinal direction of the handle 22, when the mop is lifted from any supporting surface, such as a floor, the wing parts 14, 16 may be caused to swing overcoming the fixation force generated by the snap fittings fixation of the wing parts 14, 16 in relation to the hinge component 18, provided the mop body 26 is wet and consequently exerts a physical or mechanical load on the outer ends of the wing parts 14, 16 through the snap fastener components 32 and 34, respectively. By the above described collapsing of the mop 12 the wing parts 14 and 16 are brought into a substantially mutually parallel position which allows the mop 12 to be introduced into an upper opening of the mop wringer 10, as is disclosed in the upper part of FIG. 1. The collapsing of the mop 12 is illustrated by solid arrows 36 and 38, and the shifting of the mop 12 from a position remote from the mop wringer 10 to a position shown in the upper part of FIG. 1, in which position the mop 12 may be introduced into the mop wringer 10, is illustrated by an arrow 40.

The mop squeezing apparatus or mop wringer 10 is basically constituted by a housing comprising a trough-shaped housing component 50, to which two outer walls 52 and 54 are fixed by means of fixation means such as screws 56. The housing component 50 comprises a front wall 58 and a rear wall 60 between which a trough-shaped space 66 is defined into which the mop 12 is introduced when it is to be squeezed or wrung by means of resilient, squeezing or wringing rollers 68 and 70. The housing component 50 further comprises two side walls 62 and 64 adjacent to which the above mentioned outer walls 52 and 54, respectively, are arranged defining spaces therebetween. The space defined between the outer wall 54 and the side wall 64 is partially shown in FIG. 1 as the outer wall 54 is partially cut away.

The wring rollers 68 and 70 are basically of identical structure, however, differ from one another in their fixation in the mop wringer 10 and optionally in their elasticity or resiliency. The rollers 68 and 70 are to be described in greater detail below with reference to FIG. 11. The roller 68 is a basically stationary roller, while the roller 70 is a swingable roller, which is swung from its position shown in FIG. 1, as will be described in greater detail below with reference to FIGS. 2 and 3, by means of cooperating elbows or L-shaped shaped arms 72 and 74. The swingable roller 70 is journalled at one end of the L-shaped arm 74 on a through-going shaft 76, which extends through the roller 70 and cooperates with an L-shaped arm enclosed within the space defined between the side wall 62 and the outer wall 52 at the opposite side of the apparatus 10. It is to e realized that the apparatus 10 is a basically symmetrical structure, thus, the walls 52, 54 and 62, 64 are mirror images of one another. The apparatus 10 further comprises components enclosed within the space defined between the side wall 62 and the outer wall 52, which components are identical, however, constitute mirror images of the components enclosed in the space defined between the side wall 64 and the outer wall 54. The other end of the L-shaped arm 74 is journalled on a bearing 78, which is stationary in relation to the housing 50. The position of the roller 70 is a position of rest of the roller and of the apparatus, which position is obtained by means of a return coil spring 80, one end 86 of which extends through an aperture of the L-shaped arm 74. It is to be realized that the swinging of the roller 70 is defined by the arm 74 and consequently by the shape of the L-shaped arm 74 and the journalling of the L-shaped arm 74 in relation to the housing 50, exclusively, as apertures 82 and 84 provided in the outer walls 52 and 54, respectively, merely serve the purpose of allowing the swinging of the roller 70 in relation to the housing 50. The apertures 82 and 84 do not provide any guiding of the swinging of the roller 70.

The L-shaped arm 72 is journalled on a through-going shaft, not shown in FIGS. 1–3, on the opposite end of which shaft the counterpart of the L-shaped arm 72 enclosed within the space defined between the side wall 62 and the outer wall 52 is also journalled. As will be described in greater detail below with reference to FIGS. 2 and 3, any swinging of the L-shaped arm 72 from its rest position shown in FIG. 1 causes the L-shaped arm 74 to swing as well. The swinging of the L-shaped arm 72 may be provided in any appropriate manner. Thus, the L-shaped arm 72 is provided with a toothed busing 88, which protrudes through an aperture of the outer wall 54 to the exterior in relation to the housing component 50. At the end of the busing 88 a lever assembly 90 may be mounted my means of a bolt 92, which extends through a part 94 of the assembly 90. The part 94 has a through-going hole and teeth corresponding to the teeth of the bushing 88. The outer thread, not shown on the drawings, of the bolt 92 is received in a corresponding inner thread of the busing 88 so as to bring the teeth of the part 94 and the busing 88 into engagement for fixing the lever assembly 90 in relation to the bushing 88 and further in relation to the L-shaped arm 72 in a position which may be selected by a person operating the mop wringer 10, taking into consideration the physical height of the person and the physical height of the position of the mop wringer 10. As a counterpart of the bushing 88 is provided protruding through and from an aperture of the outer wall 52, the lever assembly 90 may alternatively be mounted on the lefthand side of the apparatus 10.

As a substitute for the lever assembly 90, an arm assembly 96, FIG. 1*a* comprising a part 98 basically identical to the part 94, however provided with a radially extending arm 100 fixed by means of the bolt 92 may be employed. The arm 100 cooperates with a vertical bar 102, which is moved in reciprocating motion up and down by means of a pedal 104.

Alternatively, as seen in FIGS. 1*b* and 1*c*, the apparatus or mop wringer 10 may be operated by means of a hydraulic, pneumatic or electric power source, such as a motor assembly 106, which is energized from an electric power source, either a DC power source, such as a battery power source, preferably a rechargeable battery power source, or an AC power source, such as a mains power source, through a plug 108 and further a switch 110 of the pedal 104 or alternatively from a pneumatic or hydraulic source through a tube 112 and a valve operated by the switch 110. The arm assembly 96 and further the motor assembly 106 may comprise internal gears for transforming the motions generated by the arm assembly or the motor assembly, respectively, into an appropriate rotational motion of the bushing 88 and consequently of the L-shaped arm 72.

The operation of the mop wringer 10 shown in FIGS. 1–3 is now to be further described with reference to FIGS. 2 and 3. Initially, the arms 72, 74 are in their rest positions, indicated by solid lines in FIG. 2. Similarly, the lever assembly 90 is in a position shown in solid line. As the lever assembly 90 is manually shifted from its solid line position to its dotted line position, the L-shaped arm 72 swings from its rest position in an anti-clockwise direction to a position shown in dotted line in FIG. 2. The swinging of the L-shaped arm 72 journalled on the above mentioned shaft, the axis of which is identical to the rotational axis of the lever assembly 90, and end part 120 of the L-shaped arm 72 forces the L-shaped arm 74 to swing in a clockwise direction from its solid line position to a dotted line position, both shown in FIG. 2. It is to be realized that the shape of the L-shaped arm 72 and of the L-shaped arm 74 and their axis of rotation or swinging define the swinging of the roller 70 and further the force to be exerted by an operator by means of the lever assembly 90. Thus, the geometrical shapes of the L-shaped arms 72 and 74 are preferably computed so that the operator senses that the force he or she generates when the roller 70 is swung from its rest position towards the stationary roller 68 is an even force generation.

As the L-shaped arms 72 and 74 are further swung from their dotted line position shown in FIG. 2, the roller 70 is brought into contact with the stationary roller 68 and pressed against the latter causing both rollers 68 and 70 to be slightly deformed in their contact areas, provided no object such as the mop 12 is present between the rollers 68 and 70. During the swinging of the roller 70 from its rest position to its position adjacent to and in contact with the stationary roller 68, the end part 120 of the L-shaped arm 72 cooperates with a cam surface 122 of the L-shaped arm 74. The cam surface 122 ends in a substantially plane cam surface part 124 behind which the end part 120 of the L-shaped arm 72 locks, as the roller 70 has reached contact with the stationary roller 68 and as the rollers have been pressed against one another. As the anti-clockwise swinging to the L-shaped arm 72 proceeds, the roller 70 is maintained in its position adjacent to and in contact with the stationary roller 68, provided the mop 12 is not present between the two rollers 68 and 70, by the interlocking of the cam surface 126 of the L-shaped arm 72 and the above substantially plane cam surface part 124 of the L-shaped arm 74. The roller 70 is further forced to rotate in a clockwise direction as the L-shaped arm 72 is provided with teeth protruding beyond the cam surface 126, which teeth cooperate with a toothed wheel of the roller 70. Due to the contact between the rollers 68 and 70 or contact with the mop 12, which has been introduced into the mop wringer 10, as will be further described below, the clockwise rotation of the roller 70 is transmitted to the roller 68, which is consequently caused to rotate in an anti-clockwise direction. Furthermore, the mop 12, which is present between the rollers 68 and 70, is raised from the mop wringer 10 due to the rotations of the rollers 68 and 70. It is to be realized that the cooperating teeth 128 and toothed wheel 130 do not transmit any pressure for maintaining the swingable roller 70 in contact with the stationary roller 68 and pressed against the latter for generating a pressure force therebetween, as the pressure maintaining the roller 70 is position adjacent to and in contact with the roller 68 is generated by the cooperating cam surfaces, viz. the cam surface 126 of the L-shaped arm 72 and the plane cam surface part 124 of the L-shaped arm 74. As the swinging of the L-shaped arm 72 proceeds beyond the position shown in FIG. 3, an inclined cam surface 127 enventually becomes active and disengages the roller 70 from its contact with the stationary roller 68 for allowing the removal of the mop 12 or any other object from the mop wringer, which mop or object has not yet been disengaged from the rollers 68 and 70. The end part 120 of the L-shaped arm 72 finally reaches an end stop defined by a rubber or resilient elastomeric body 134. The L-shaped arm 72 is also provided with a similar stopper means 136 absorbing the return swinging motion of the L-shaped arm 72 when swung clockwise to its rest position shown in FIGS. 1 and 2. For swinging the L-shaped arm 72 to its rest position, the shaft mentioned above, on which shaft the bushing 88 is mounted, is preferably provided with a return spring, not shown in FIGS. 1–3.

The apparatus 10 shown in FIGS. 1–3 is used in a conventional manner known per se and mounted above a container with water or water with a rinsing compound such as soap or the like, possibly mounted on a wall mounting, cleaner carriage or the like, e.g. on a tube of the carriage, which tube is received in a recess 132 of the housing component 50. The operator introduces the mop 12 in the collapsed position shown in the upper part of FIG. 1 into the space 66 of the apparatus 10 and lowers the mop body 26 of the mop 12 into the water of the above container. After having cleaned the mop body 26 of the mop 12, the operator raises the mop 12 from the container and into a position between the rollers 70 and 68 and pulls the lever assembly 90 in order to bring the roller 70 into contact with the stationary roller 68. Due to the presence of the mop 12 between the rollers 68 and 70, the rollers 68 and 70 are deformed causing the generation of a fairly high squeezing pressure between the rollers, which squeezing pressure is applied to the mop. It is to be realized that during the swinging of the movable roller 70 from its rest position shown in solid line in FIG. 2 to its position in contact with the roller 68 during which swinging the end part 120 is cooperating with the cam surface 122, two operations are performed. First, the swinging itself, second, during the last part of the swinging of the L-shaped arm 74, the deformation of the rollers and further the accumulation of pressure between the rollers 68 and 70. When the L-shaped arm 72 locks behind the cam surface 124, just before the teeth 128 are initiating their cooperation with the toothed wheel 130 of the roller 70, the pressure generated between the two rollers 68 and 70 has reached its maximum. While the cam surface 126 is interacting with the cam surface 124, during which interaction the teeth 128 are interacting with the toothed wheel 130 of the roller 70, the distance between the rollers 68 and 70 is maintained substantially constant. However, in case the shape or profile of the mop 12, which is squeezed through the apparatus 10, changes, the pressure generated between the two rollers 68 and 70 also changes thereby causing a change in the pressure to which the mop 12 is exposed.

As mentioned above, the wringing roller 68 is a basically stationary roller, which means that under normal pressure conditions the roller 68 is maintained stationary relatively to the housing component 50. However, the wringing roller 68 is mounted in bearing parts at opposite ends of the roller, one of which bearing parts 140 is shown in FIGS. 1–3. The bearing part 140 and the counterpart at the opposite end of the roller 68 are guided in guiding parts provided at the opposite side walls 62 and 64 of the housing component 50. The guiding part of the side wall 64 cooperates with the bearing part 140 and is designated the reference numeral 142. The bearing part 140 is forced against a motion limiting end wall of the guiding part 142 by a helical coil 144. Obviously, a helical coil corresponding to the coil 144 is provided at the opposite end of the wringing roller 68 cooperating with the counterparts corresponding to the bearing part 140 and the guiding part 142. It is to be emphasized that the helical coil 144 and its counterpart at the opposite end of the wringing roller provides a pressure, which far exceeds the pressure normally applied to the mop body 26 as the mop 12 is wrung through the mop wringer 10. The wringing pressure generated in the mop wringer according to the present invention is generated by the surfaces of the rollers exclusively, as the roller 70 is maintained in a fixed position relative to the roller 68 by the interaction of the cam surface 126 and the plane cam surface part 124 and as the roller 68 is maintained in a stationary position relative to the housing component 50 by the force exerted by the helical coils. The bearing of the wringing roller 68 as described above basically provides an overloading proof journalling of the wringing roller 68.

The wringing rollers 68 and 70 are of a structure which is to be described in greater detail below with reference to FIG. 11 and are of an elastic, yet tough and self-healing material. The rollers 68 and 70 are of a resiliency of less than 80 Shore (A), such as 40–70 Shore (A), preferably 45–65 Shore (A). Rollers of different resiliency have been tested, from very soft foam rollers to solid rollers (80 Shore (A)). All rollers, however, operated satisfactorily. Rollers of differing resiliency have also been tested. Thus, pairs of rollers 68 and 70 of elasticities or resiliencies of 45 Shore (A) and 65 Shore (A), respectively, and 50 Shore (A) and 55 Shore (A) have been tested with satisfactory results. For production reasons, it is, however, preferred to employ rollers 68, 70 of identical resiliency, preferably of the order of approximately 50 Shore (A). The rollers 68 and 70 are preferably made from foamed polyurethane foam (PU-foam), and the remaining basic components of the apparatus described above are preferably made from durable high-strength plastics material such as polystyrene, acrylonitrilbutadienestyrene, polypropene, polyvinylchloride, polyamids, nylon, polyoxymethacrylats, etc. Thus, the components 72, 74, 140 and 142 are preferably made from high-strength materials such as polymethacrylats or nylon. Alternatively, some of the components, e.g. the L-shaped arms 72 and 74 may be made from aluminium.

In FIGS. 4–11, a second to eighth embodiment of the mop wringer according to the present invention are shown schematically illustrating end views of the embodiments. Thus, the embodiments shown in FIGS. 4–10 preferably comprises counterparts corresponding to the components shown in FIGS. 4–10, which counterparts will not be described in detail below.

Figure 4:
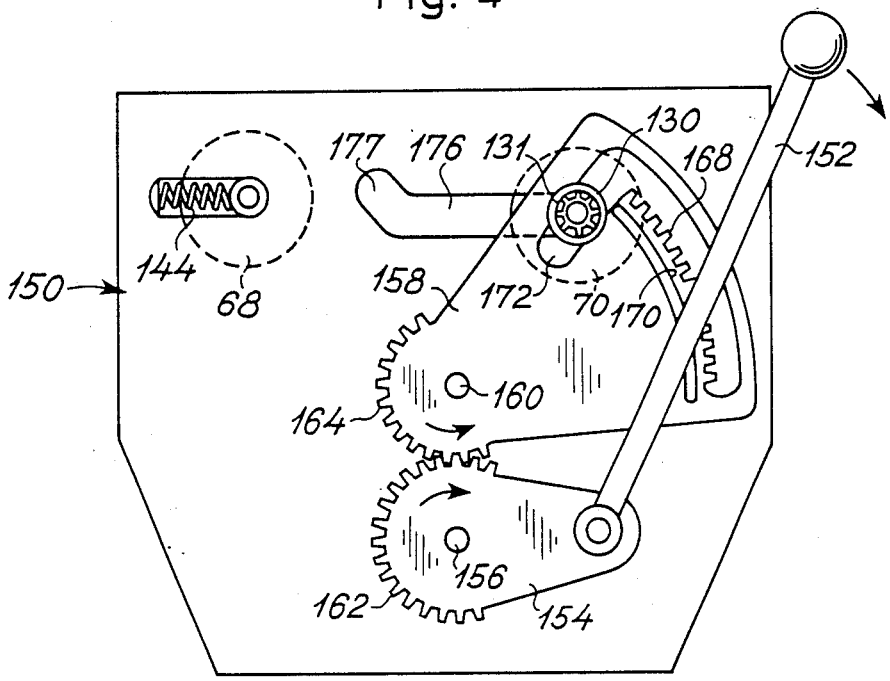

The second embodiment of the mop wringer according to the present invention shown in FIG. 4 comprises a housing component 150 in which the above described rollers 68 and 70 are journalled. Like in the above described first and presently preferred embodiment 10 of the mop wringer, the roller 68 is a stationary roller journalled in basically the same manner as described above, and the roller 70 is a movable roller, which is journalled in a bearing bushing 131 and moved by means of guiding means comprising two components 154 and 158 from its rest position shown in FIG. 4 into a position adjacent to and in contact with the stationary roller 68, which components substitute the L-shaped arms 72, 74 shown in FIGS. 1–3. The components 154 and 158 are journalled on bearings 156 and 160, respectively, and are provided with outer, mutually cooperating teeth 162 and 164, respectively. The component 154 is connected to a handle 152, which may be swung in a clockwise direction as indicated by an arrow.

By swinging motion of the handle 152, the component 154 rotates in a clockwise direction as indicated by an arrow, by which rotation the component 158 is caused to swing or rotate in an anti-clockwise direction, also indicated by an arrow. The roller 70 is guided from its rest position to its activated position adjacent to and in contact with the roller 68 by an L-shaped aperture 172 of the component 158 and by a guiding aperture 176 of the housing component 150. The aperture 176 is provided with an aperture part 177, in which the bushing 131 of the roller 70 is locked, as the roller 70 is pressed against the roller 68. The component 158 is further provided with a cam surface 170, which corresponds to the cam surface 126 of the L-shaped arm 72, shown in FIGS. 1–3, and serves the purpose of maintaining the roller 70 in a fixed position adjacent to and in contact with the roller 68.

For rotating the roller 70 in a clockwise direction as discussed above, the component 158 is provided with teeth 168 corresponding to the teeth 128 of the L-shaped arm 72 shown in FIGS. 1–3 and for cooperating with the toothed wheel 130 of the roller 70. Like in the above described, first and presently preferred embodiment, the second embodiment of the mop wringer shown in FIG. 4 may be provided with return means such as a coil for returning the components 154 and 158, and consequently the roller 70 from its active position to its rest position shown in FIG. 4, which return means may cooperate with any of the components 154 and 158.

Figure 5:
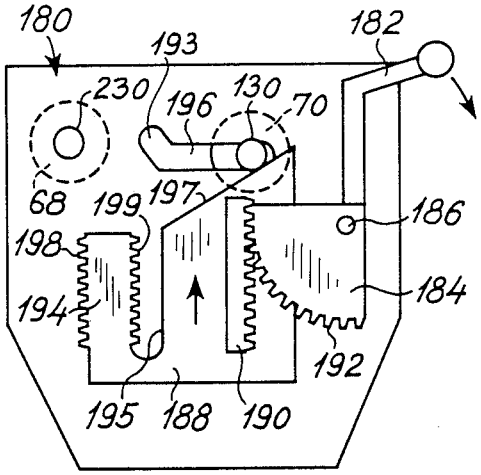

The third embodiment of the mop wringer according to the present invention shown in FIG. 5 comprises a housing component 180, in which the above described rollers 68 and 70 are journalled in a manner basically corresponding to the manner discussed above with reference to FIGS. 1–4. Thus, the roller 68 constitutes a stationary roller, while the roller 70 is a movable roller moved from its rest position shown in FIG. 5 to its active position in which the roller 70 is arranged adjacent to and in contact with the roller 68. Contrary to the above described first embodiment shown in FIGS. 1–3, the movement of the roller 70 from its rest position to its active position is guided by a guiding aperture 196 of the housing component 180, which guiding aperture 196 basically corresponds to the aperture 176 shown in FIG. 4 and has the same shape comprising an end part 193, in which the roller 70 is located. The roller 70 may further be guided in a bearing bushing of the type described above and designated the reference numeral 131 in FIG. 4. As the movement of the roller 70 from its rest position shown in FIG. 5 to its active position is guided by the aperture 196, a return means such as a coil, not shown in FIG. 5, is preferably provided for returning the roller 70 to its rest position.

The mop wringer further comprises the following components. A lever 182 is rigidly connected to a toothed wheel 184 and is journalled on a shaft 186. The toothed wheel 184 is provided with teeth 192, which cooperate with teeth 190 of a component 188, which may be raised as indicated by an arrow in the centre of FIG. 5 by the interaction of the teeth 190 and 192 and further by the rotation of the handle 182 in a clockwise direction. The component 188 is provided with an upper, sloping cam surface 197, which serves the purpose of applying pressure to the roller 70 for moving the roller 70 from its rest position into contact with the roller 68, when the component 188 is raised. When the roller 70 reaches its active position it is fixed by the interaction between the shaft of the roller 70 and a vertical cam surface 195 of the component 188. The component 188 is further provided with a toothed part 194, which is provided with two sets of teeth 198 and 199, which are adapted to cooperate with toothed wheels 230 and 130 of the rollers 68 and 70, respectively.

Figure 6:
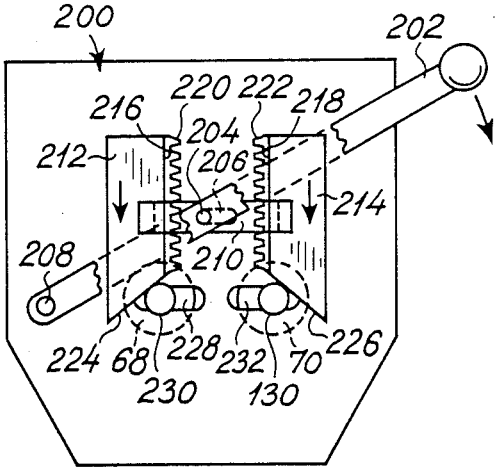

The fourth embodiment of the mop wringer according to the present invention shown in FIG. 6 comprises a housing component 200, in which a lever 202 is journalled on a journalling shaft 208. Contrary to the above described first, second and third embodiments of the mop wringer according to the present invention, the rollers 68 and 70 of the fourth embodiment are rollers, which are moved in relation to one another for bringing the rollers in contact with one another. Thus, the rollers 68 and 70 are guided in their reciprocating movement to and from one another in guiding apertures 228 and 232, respectively, of the housing component 200. Like in the above described third embodiment of the mop wringer according to the present invention shown in FIG. 5, the roller 68 is also provided with a toothed wheel 230. Furthermore, the rollers 68 and 70 are preferably journalled in bearing bushings, not shown in FIG. 6.

The movement of the rollers 68 and 70 to and from one another, the generation of a constant pressure between the rollers and the rotation of the rollers are generated by means of two components 212 and 214, which basically constitute mirror images of one another and are mounted on a solid bar 210, in which an aperture 206 is provided. Into the aperture 306 a guiding pin 204 protrudes, which is solidly connected to the lever 202. When the lever 202 is swung in a clockwise direction as indicated by an arrow, the components 212 and 214 are consequently caused to descend by the interaction of the guiding pin 204 and the aperture 206. The descending movement of the components 212 and 214 is indicated by arrows. Like in the above first, second and third embodiment of the mop wringer according to the present invention, the operation of the mop wringer is a two-step operation comprising a first step, in which the rollers are guided, swung or simply moved into contact with one another by the interaction between cam surfaces, and a second part in which the rollers are maintained in their positions adjacent to and in contact with one another and further caused to rotate relative to one another for raising a mop previously introduced into the mop wringer therefrom. For generating the first step of the operation, viz. the movement of the rollers into contact with one another, the components 212 and 214 are provided with cam surfaces 224 and 226, respectively, which cooperate with the shafts of the rollers 68 and 70, respectively. For generating the second step of the operation, viz. for maintaining the rollers 68 and 70 in their active positions in contact with the adjacent to one another and for rotating the rollers 68 and 70 in an anti-clockwise and clockwise direction, respectively, the components 212 and 214 are provided with cam surfaces 216 and 218, respectively, and further provided with sets of teeth 220 and 222, respectively, for cooperating with the toothed wheels 230 and 130, respectively, of the rollers 68 and 70, respectively.

Figure 7:
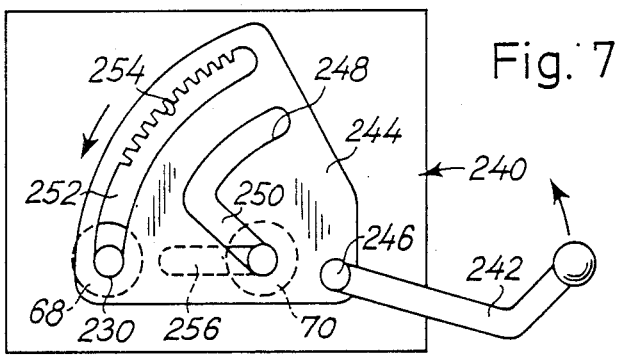

The fifth embodiment of the mop wringer according to the present invention is shown in FIG. 7 and comprises a housing component 240, in which the rollers 68 and 70 are journalled. Like in the above described first, second and third embodiments of the mop wringer shown in FIGS. 1–5, the roller 68 is a stationary roller, and the roller 70 is a movable roller. The movable roller 70 is moved from its rest position shown in FIG. 4 into an active position adjacent to and in contact with the roller 68 in a manner to be described below. For allowing the roller 70 to move from its rest position to its active position in contact with the roller 68, an aperture 256 is provided in the housing component 240. The aperture 256 only serves the purpose of allowing the movement of the roller 70 i relation to the housing component 240. Thus, the aperture 256 does not provide any guiding of the roller 70 in its movement. The operation of the fifth embodiment shown in FIG. 7 is established by a lever or handle 242, which is rigidly connected to a component 244 and journalled on a shaft 246. As the lever or handle 242 is raised and consequently swung in an anti-clockwise direction indicated by an arrow, the component 244 is also swung in an anti-clockwise direction in relation to the axis of the shaft 246. The swinging of the component 244 is indicated by an arrow. For guiding the roller 70 in its movement in relation to the housing component 240 and further in relation to the roller 68, the component 244 is provided with an L-shaped aperture 250, which defines a cam surface 248. The cam surface 248 basically serves the same purpose as e.g. the cam surface 170 of the second embodiment of the mop wringer shown in FIG. 4, viz. the purpose of maintaining the roller 70 in contact with the roller 68, when the roller 70 has been moved from its rest position to its active position and further for generating a predetermined pressure between the two rollers. For causing the rollers 68 and 70 to rotate in an anticlockwise direction and a clockwise direction, respectively, the component 244 is provided with teeth 254 of an aperture 252. The teeth 254 are adapted to cooperate with the toothed wheel 230 of the roller 68. Thus, the roller 70 in FIG. 7 is not necessarily provided with a toothed wheel such as the toothed wheel 130 of the roller 70 shown in FIGS. 1–6. However, as the rollers 68 and 70 are preferably of identical structure, the roller 70 in FIG. 7 may preferably be provided with the above described toothed wheel 130, which, however, is superfluous in the embodiment shown in FIG. 7.

A main advantage of the fifth embodiment of the mop wringer shown in FIG. 7 is the fact that the wringer is made of a minimum number of components, viz. the housing component 240, the rollers 68 and 70, a single movement causing, pressure generating, pressure applying and further rotation generating component 244, and a lever 242 journalled on a bearing 246. Apart from these components, the embodiment shown in FIG. 7 may advantageously merely be provided with a return coil e.g. cooperating with the component 244 or with the lever 242.

Figure 8:
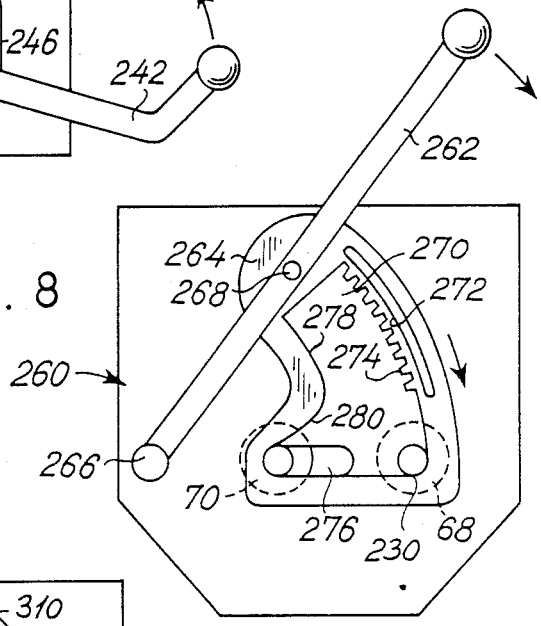

In FIG. 8, a sixth embodiment of the mop wringer according to the present invention is shown comprising a housing component 260, in which a lever 262 is journalled on a bearing 266. A component 264 basically serving the same purpose as the component 244 described above is rigidly connected to the lever 252 through a pin 268. When the lever 262 is lowered as indicated by an arrow and consequently swung in a clockwise direction in relation to the axis of the bearing 266, the component 264 is lowered. Like in the above described first, second, third and fifth embodiments of the mop wringer shown in FIGS. 1–3, 4, 5 and 7, respectively, the roller 68 is a stationary roller, while the roller 70 is movable roller. However, in FIG. 8 the positions of the rollers 68 and 70 have been reversed. The aperture 270 of the component 264 further defines teeth 274, which are adapted to cooperate with the toothed wheel 230 of the roller 68 in basically the same manner as described above with reference to FIG. 7. To ensure that the toothed wheel 230 and teeth 274 do not apply any excessive pressure or force on one another, which could otherwise clog the apparatus or cause a heavy loading of the cooperating teeth and toothed wheel or make the operation of the mop wringer heavy, the component 264 is preferably provided with a cam surface 272 for cooperating with the shaft of the roller 68. Like the above described fifth embodiment of the mop wringer according to the present invention, the sixth embodiment shown in FIG. 8 comprises a minimum number of components and may as discussed above be provided with a return means cooperating with e.g. the lever 262. The movement of the movable roller 70 is generated by the component 264 and further guided by a guiding slot or aperture 276 of the housing component 260 and still further by an inner L-shaped cam surface of the component 264, which L-shaped cam surface comprises two surfaces 278 and 280. The cam surface 280 is operating while the roller 70 is moved towards the roller 68, while the cam surface 278 serves the same purpose as e.g. the cam surface 248 of the component 244 shown in FIG. 7, viz. the purpose of maintaining the roller 70 in its active position in relation to the roller 68 and further in relation to the housing component 260.

In FIG. 9, a seventh and somewhat different implementation of the mop wringer according to the present invention is shown. The seventh embodiment comprises a housing component 290, in which the rollers 68 and 70 are journalled for reciprocating movement to and from one another like in the above described fourth embodiment of the mop wringer shown in FIG. 6. For causing the rollers 68 and 70 to move to and from one another and further rotate in an anti-clockwise and a clockwise direction, respectively, after having been shifted from their rest positions shown in FIG. 9 to their active positions in contact with one another, the embodiment is provided with two components 294 and 298, which are journalled on bearings 296 and 300, respectively. The component 294 is rigidly connected to a handle 292, and the components 294 and 298 are provided with interlocking teeth 302 and 304, respectively. When the handle 292 is raised as indicated by an arrow, the component 294 is caused to rotate in an anti-clockwise direction as also indicated by an arrow, while the component 298 is caused to rotate through its engagement with the component 294 in a clockwise direction.

The rollers 68 and 70 are guided in guiding apertures or guiding slots 316 and 314, respectively, of the housing component 290 and are further forced towards one another by their cooperation with cam surfaces 307 and 309, respectively, of the components 298 and 294, respectively, as the components 294 and 298 are swung as described above. When the rollers 68 and 70 are brought into contact with one another, the rollers are locked in their active positions as cam surfaces 306 and 308 of the components 294 and 298, respectively, lock behind the rollers 70 and 68, respectively. The rollers 70 and 68 are further caused to rotate by the interaction between teeth 310 and 312 of the components 294 and 298, respectively, and the toothed wheels 130 and 230, respectively.

The seventh embodiment of the mop wringer shown in FIG. 9 is to a great extent similar to the fourth embodiment of the mop wringer shown in FIG. 6 as the rollers 68 and 70 are both operated by components which are positioned symmetrically in relation to one another and constitute mirror images of one another. However, while the operation of the rollers 68 and 70 in the above fourth embodiment is established by the linearly moving or vertically reciprocating components 212 and 214, the operation of the rollers 68 and 70 is established in the seventh embodiment of mop wringer shown in FIG. 9 by the interaction and swinging motions of the components 294 and 298.

In fifth, sixth, seventh and eighth embodiments of the mop wringer shown in FIGS. 7, 8, 9 and 10, respectively, the rollers 68 and 70 or at least the movable roller 70 is preferably journalled in a bearing bushing, not shown in the individual figures, however corresponding to the bearing bushing 131 shown in FIG. 4.

Common to the embodiments of mop wringer described above with reference to FIGS. 1–9 is the fact that the operation of the rollers 68 and 70 is established by one or more components moved reciprocatingly or swung so as to cause at least one of the rollers to perform a reciprocating movement. Thus, in an overall view of the embodiments of the mop wringer shown in FIGS. 1–9, the rollers are only allowed to perform movements in relation to the housing component of the embodiment in question, which movements only cause the rollers to be brought into with one another. After contact has been established between the rollers, they are maintained in their operational or active positions and caused to rotate. As will be understood and as described above with reference to FIGS. 1–3, the rotation of the rollers 68 and 70 causes the mop, e.g. the mop 12 shown in FIG. 1, to be raised in relation to the mop wringer.

In the eighth embodiment of the mop wringer shown in FIG. 10, the mop, which has been introduced into the mop wringer, is maintained in a substantially fixed position in relation to the mop wringer while the mop squeezing or mop wringing rollers are caused to be lowered in relation to the mop and further in relation to the mop wringer. Thus, in a housing component 320, the mop squeezing rollers, which are not shown in FIG. 10, are mounted in a vertically movable support component 330, the vertical movement of which is indicated by an arrow. However, the toothed wheels 130 and 230 of the squeezing rollers are shown in FIG. 10. The squeezing rollers mounted in the support component 330 are guided in relation to the support component 330 in guiding apertures or guiding slots 332 and 334 of the support component 330. The support component 330 may be lowered or raised by means of a handle 322, which is journalled on a bearing 328 and is provided with a protruding pin 324, which protrudes into and interacts with a guiding slot 326 of the support component 330. Thus, as the lever 322 is lowered or swung in a clockwise direction as indicated by an arrow, the support component 330 is lowered and the rollers are consequently also lowered. The operation of the rollers is further established by a guiding plate 338, which is rigidly supported by the housing component 320 and is provided with a central aperture 340. The central aperture 340 defines two cam surfaces 342 and 344 serving the purpose of guiding the rollers towards one another in the abovementioned first step of the operation of the mop wringer for causing the rollers to be brought into contact with one another. When the rollers have been brought into contact with one another, they are maintained in the mutual contact by means of cam surfaces 346 and 350, which cam surfaces basically correspond to the cam surfaces 218 and 216, respectively, of the fourth embodiment of the mop wringer shown in FIG. 6. The mop squeezing rollers are further caused to rotate by the interaction between the toothed wheels 130 and 230 thereof and teeth 348 and 352 of the component 338. Apart from the advantageous feature that the mop is maintained and consequently not moved in relation to the mop wringer, when the mop wringer is operated, a further advantage of the eighth embodiment according to the present invention shown in FIG. 10 is that the eighth embodiment like the fourth, fifth and sixth embodiments shown in FIGS. 6, 7 and 8, respectively, comprises a minimum number of components, viz. the support component 330, the guiding component 338 and a lever assembly comprising the lever 322, the pin 324, the guiding slot 326 and the bearing 328. Apart from these components and the mop squeezing rollers, the eighth embodiment shown in FIG. 10 only further comprises a return means which preferably cooperates with the lever 322.

It is to be realized that the housing components 150, 180, 200, 240, 260, 290 and 320 shown in FIGS. 4–10, respectively, are schematic housing components, which may be implemented e.g. in accordance with the above described first, presently preferred embodiment of the mop wringer according to the present invention shown in FIGS. 1–3.

It is further to be realized that in the fourth, fifth, sixth, seventh and optionally eighth embodiment shown in FIGS. 6, 7, 8, 9 and 10, respectively, return means such as a return coil or a cam surface is preferably provided like in the third embodiment shown in FIG. 5 and described above.

Furthermore, the housing components 50, 150, 180, 220, 240, 260, 290 and 320 shown in FIGS. 1–10 may be integrated with the above container.

In FIG. 11, the presently preferred embodiment of the roller 68, 70 is shown. The roller is basically made of a roller body 358 comprising a central core body 368, which may be be constituted by a segment of an extruded PVC string provided with internally protruding fins 370, a soft plastics sheathing 364, which is provided with fins 366, and which is preferably constituted by a soft PVC body coextruded with the hard PVC core body 368, and a foamed polyurethane body 362, which defines an outer side surface 360 of the roller 68, 70 and two plastics bodies one at each end of the roller body 358, and one of which is shown in the lower right-hand side of FIG. 11 and designated the reference numeral 380. As will be understood, the roller body is manufactured from a minimum number of components, viz. a length of a coextruded body comprising the central, hard PVC core body 368 and the soft plastics sheathing 364 and the foamed outer body 362. A further advantage of the rollers implemented in accordance with the structure described above is the fact that the outer side surface 360 is extremely tough and has as a self-healing capability. Thus, it is believed that rollers of the above type may be used in other applications, e.g. in conveyor systems, transportation devices, roller floors, roller skates, wheels for transport devices and numerous other fields and further be used as either drive rollers or idle rollers. The roller body is journalled by means of the two pressure cast plastics bodies, which are simply fitted into the inner space defined within the central core 368 before or after the foaming of the foamed body 362. The plastics body 380 comprised a central cylindrical part 374, from which fins 376 protrude defining ridges 368 for cooperating with the fins 370 of the core body 368. From the opposite end of the cylindrical part 374, the toothed wheel 130, 230 protrudes. In e.g. a conveyor systems, a plurality of rollers of the type described above provided with two plastics bodies of the above type may be operated in synchronism as the individual roller may be journalled by means of the cylindrical parts 374 of the plastics bodies and may by operated by means of e.g. one or two tooth belts cooperating with the toothed wheel 130, 230.

The roller 68, 70 of the above described embodiments of the mop wringer according to the present invention may obviously be implemented in accordance with other techniques, e.g. be constituted by rubber bodies, soft plastics cylindrical bodies or the like. However, by the employment of the squeezing roller 68, 70 shown in FIG. 11 a further advantage is obtained as the fins 366 of the soft plastics part 364 provide a highly advantageous pressure variation, which enhances the squeezing effect of the mop wringer. Thus, it is to be understood that in the operation of the mop wringer according to the present invention, the rollers are maintained in a predetermined, fixed distance in contact with one another and pressed against one another by means of the above described cam surfaces, and the rollers are caused to rotate by means of its toothed wheels 130 and 230 cooperating with the above teeth. Apart from the internal distance between the cooperating rollers 68 and 70 and consequently the pressure generated by the contact and deformation of the foamed bodies 362 of the rollers, the squeezing or wringing effect is further determined by the soft plastics fins 366, which during the rotation of the individual roller provide a varying pressure gradient and enhances the squeezing or wringing effect of the entire apparatus.

The soft plastics sheathing 364 further provides the highly advantageous feature that, provided the sheathing 364 is made from a material with high affinity to the material of the core body 368 and consequently is fixedly joined to the core body 368 a link is provided between the rotation generating core body 368 and the pressure generating and/or pressure transmitting foamed body 362. Thus, although the foamed body 362 due to its deformation during operation is disengaged from the sheathing 364, the fins 366 ensure that the foamed body 362 is still caused or forced to rotate when the core body 368 is rotated.

In the above roller implementation shown in FIG. 11, the journalling of the roller may be modified by providing inner or outer journal bearings, roller bearings, etc.

EXAMPLE

The mop wringer shown in FIGS. 1–3 was implemented from the following components and materials. The rollers 68 and 70 were made from a solid hard PVC tube 368 of an outer diametre of 28 mm and of a wall thickness of 1.5 mm, coextruded with a soft PVC sheathing 364. The fins 366 of the soft PVC sheathing 364 extended approximately 5 mm from the outer peripheral surface of the hard PVC tube 368. The overall length of the roller body 358 was approximately 187 mm, and the outer diametre of the roller body 358 was approximately 58 mm. The plastics bodies 380 were cast from nylon. The trough-shaped housing component 50 defined an inner width of approximately 192 mm and has an overall height of 267 mm, an overall width of approximately 252 mm, and an overall depth of approximately 265 mm. The housing component 50 was cast from polystyrene. The L-shaped arms 72 and 74 were cast from nylon. The length of the cam surface 122 was approximately 65 mm, and the length of the cam surface 124 was approximately 17 mm. The peripheral length of the cam surface 126 was approximately 120 mm, and the length of the cam surface 127 was approximately 17 mm. The shapes of the arms 72 and 74 were computer designed in the configurations shown in FIGS. 2 and 3 so as to make an operator sense that he or she has to generate an even force when operating the mop wringer 10 by pulling the handle 90. Thus, tests have been made by which it has been revealed that under normal operational conditions the force to be generated by the operator is less than 50 kg, even with extreme mops. Conventionally, the force to be generated by the operator is of the order of 10–30 kg.

Although the invention has been described with reference to a plurality of specific embodiments of the different aspects of the present invention, it is to be realized that numerous modifications and adaptations are obvious to a person having ordinary skill in the art and that such modifications or adaptations are to be considered part of the present invention as defined in the appending claims.

I claim:

1. A mop wringer comprising:

a housing, a pair of rotatable, wringing rollers having resilient roller bodies, at least one of said rollers being movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a drive wheel for receiving rotational motion for causing said rollers to rotate in opposite directions when in said active position, and actuator means movable from a first position, through a second position and to a third position, and comprising a first and second cam surface and a roller drive means, said first cam surface guiding said movable roller from said inactive position to said active position, when said actuator means is moved from said first position to said second position, said second cam surface locking said movable roller in said second position, when said actuator means is moved from said second position to said third position and when said actuator means is moved from said third position to said second position, and said roller drive means transmitting rotational motion to said drive wheel when said actuator means is moved from said second position to said third position and when said actuator means is moved from said third position to said second position.

2. A mop wringer according to claim 1, both rollers of said pair of rollers being movable rollers actuated by said actuator means for moving both rollers from their inactive positions into contact with one another in their active positions.

3. A mop wringer according to claim 2, said drive wheel being a toothed wheel, and said roller drive means being a toothed rack.

4. A mop wringer according to claim 3 having a handle for moving said actuator means from said first position through said second position, and to said third position.

5. A mop wringer comprising:

a housing having opposite end walls, a pair of rotatable, wringing rollers having resilient roller bodies, said rollers extending between said opposite end walls of said housing and being journalled at opposite ends thereof, at least one of said rollers being movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a drive wheel for receiving rotational motion for causing said rollers to rotate in opposite directions when in said active position, and actuator means movable from a first position, through a second position and to a third position, said movable actuator means comprising a pair of actuator means provided at respective opposite end walls of said housing and actuating said movable roller at opposite ends thereof, each of said pair of actuator means comprising a first and second arm means defining a first and a second cam surface, respectively, and a roller drive means, said first cam surface guiding said movable roller from said inactive position to said active position, when said actuator means is moved from said first position to said second position, said second cam surface locking said movable roller in said second position, when said actuator means is moved from said second position to said third position and when said actuator means is moved from said third position to said second position, and said roller drive means transmitting rotational motion to said drive wheel when said actuator means is moved from said second position to said third position and when said actuator means if moved from said third position to said second position.

6. A mop wringer according to claim 5, both rollers of said pair of rollers being movable rollers actuated by said pair of actuator means for moving both rollers from their inactive positions into contact with one another in their active positions.

7. A mop wringer according to claim 6, said drive wheel being a toothed wheel, and said roller drive means being a toothed rack.

8. A mop wringer according to claim 7 having a handle for moving said actuator means from said first position through said second position and to said third position.

9. A mop wringer comprising:

a housing having opposite end walls, a pair of rotatable, wringing rollers having resilient roller bodies said rollers, extending between said opposite end walls of said housing and being journalled at opposite ends thereof, at least one of said rollers being movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a drive wheel for receiving rotational motion for causing said rollers to rotate in opposite directions when in said active position, and actuator means movable from a first position, through a second position and to a third position, said movable actuator means comprising a pair of actuator means provided at respective opposite end walls of said housing and actuating said movable roller at opposite ends thereof, each of said pair of actuator means comprising a first and a second arm means defining a first and a second cam surface, respectively, and a roller drive means, said first cam surface guiding said movable roller from said inactive position to said active position, when said actuator means is moved from said first position to said second position, said second cam surface locking said movable roller in said second position, when said actuator means is moved from said second position to said third position and when said actuator means is moved from said third position to said second position, and said roller drive means transmitting rotational motion to said drive wheel when said actuator means is moved from said second position to said third position and when said actuator means is moved from said third position to said second position, said first arm means being journalled swingable at one end thereof in said housing, said movable roller being journalled in said first arm means at an opposite end of said first arm means, said second arm means being journalled swingable at one end thereof in a journalling bearing in said housing, said second arm means having an abutment means at an opposite end thereof for engagement with said first cam surface, said second cam surface defining a segment of a circle having its center at said journalling bearing, said second arm means being swingable from said first position to said second position for swinging said movable roller from its inactive position to its active position by the transmission of said swinging of said second arm means to a swinging of said first arm means through the engagement between said abutment means and said first cam surface, said second arm means being swingable from said second position to said third position, and said second cam surface engaging with said opposite end of said first arm means when said second arm means is swinging from said second position to said third position.

10. A mop wringer according to claim 9, said toothed rack being arranged in parallel with said second cam surface so as to engage with said toothed wheel of said movable roller, when said second cam surface is in said engagement with said opposite end of said first arm means.

11. A mop wringer according to claim 10 having a handle for moving said actuator means from said first position through said second position, and to said third position.

12. A mop wringer comprising:

a housing having opposite end walls, a pair of rotatable, wringing rollers having resilient roller bodies, said rollers extending between said opposite end walls of said housing and being journalled at opposite ends thereof, at least one of said rollers being movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a toothed drive wheel for receiving rotational motion for causing said rollers to rotate in opposite directions when in said active position, and actuator means movable from a first position, through a second position and to a third position, said movable actuator means comprising a pair of actuator means provided at respective opposite end walls of said housing and actuating said movable roller at opposite ends thereof, each of said pair of actuator means comprising a first swingable means having a first toothed wheel and a second swingable means having a second toothed wheel, said second swingable means comprising a toothed rack, said first and second toothed wheels meshing with one another for transmitting any swinging of any of said swingable means to the other, said second swingable means defining a first and a second cam surface, said first swingable means being swingable from said first position, through said second position, and to said third position, said second cam surface of said second swingable means defining a segment of a circle having its centre at the centre of swinging of said second swingable means, the swinging of said first swingable means from said first position to said second position being transmitted to said second swingable means through said meshing toothed causing said first cam surface of said second swingable means to guide said movable roller from its inactive position to its active position, and the swinging of said first swingable means from said second position to said third position being transmitted to said second swingable means through said meshing toothed wheels causing said second cam surface to lock said movable roller in said active position and further causing said at least one roller to rotate by engagement between said toothed rack of said second swingable means and said toothed drive wheel of said at least one roller.

13. A mop wringer according to claim 12 having a handle for moving said actuator means from said first position through said second position, and to said third position.

14. A mop wringer comprising:

a housing having opposite end walls, a pair of rotatable, wringing rollers having resilient roller bodies, said rollers extending between said opposite end walls of said housing and being journalled at opposite ends thereof, at least one of said rollers being movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a toothed drive wheel for receiving rotational motion for causing said rollers to rotate in opposite directions when in said active position, and actuator means movable from a first position, through a second position and to a third position, said movable actuator means comprising a pair of actuator means provided at respective opposite end walls of said housing and actuating said movable roller at opposite ends thereof, each of said pair of actuator means comprising a swingable plate means having an aperture defining a first and a second cam surface and further comprising a toothed rack, said swingable plate means being swingable from said first position, through said second position and further to said third position, said second cam surface defining a segment of a circle having its centre at the centre of swinging of said swingable plate means, the swinging of said swingable plate means from said first position to said second position causing said first cam surface to guide said movable roller from its inactive position to its active position, and the swinging of said plate means from said second position to said third position causing said second cam surface to lock said movable roller in said second position, and further causing said toothed rack to make said at least one roller rotate by its engagement with said toothed wheel.

15. A mop wringer according to claim 14 having a handle for moving said actuator means from said first position through said second position, and to said third position.

16. A mop wringer comprising:

a housing having opposite end walls, a pair of rotatable, wringing rollers having resilient roller bodies, said rollers extending between said opposite end walls of said housing and being journalled at opposite ends thereof, at least one of said rollers being movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, and at least one of said rollers being provided with a drive wheel for receiving rotational motion for causing said roller to rotate in opposite directions when in said active position, and actuator means movable from a first position, through a second position and to a third position, said movable actuator means comprising a pair of actuator means provided at respective opposite end walls of said housing, and actuating said movable roller at opposite ends thereof, each of said pair of actuator means comprising a first and second arm means defining a first and a second cam surface and a roller drive means, said first cam surface guiding said movable roller from said inactive position to said active position, when said actuator means is moved from said first position to said second position, said second cam surface locking said movable roller in said second position, when said actuator means is moved from said second position to said third position and when said actuator means is moved from said third position to said second position, and said roller drive means transmitting rotational motion to said drive wheel when said actuator means is moved from said second position to said third position and when said actuator means is moved from said third position to said second position, each of said pair of actuator means comprising a reciprocating, movable guiding means defining said first and second cam surfaces and having said toothed rack, and further being movable from said first position, through said second position, and to said third position.

17. A mop wringer according to claim 16 having a handle for moving said actuator means from said first position through said second position, and to said third position.

18. A mop wringer comprising:

a housing, a pair of rotatable, wringing rollers having resilient roller bodies, at least one of said rollers being movable between an inactive position in which said rollers are out of contact with one another and in spaced apart relation and an active position in which said rollers are in contact with one another and pressed against one another so as to cause said roller bodies to be deformed and to generate a wringing pressure between said roller bodies, at least one of said rollers being provided with a drive wheel for receiving rotational motion for causing said rollers to rotate in opposite directions when in said active position and at least one of said rollers being constituted by a roller having a foamed, resilient body of a resiliency of less than 80 Shore (A), such as 40–65 Shore (A), preferably 45–60 Shore (A), further preferably 50–55 Shore (A), and actuator means movable from a first position, through a second position and to a third position, and comprising a first and a second cam surface and a roller drive means, said first cam surface guiding said movable roller from said inactive position to said active position, when said actuator means is moved from said first position to said second position, said second cam surface locking said movable roller in said second position, when said actuator means is moved from said second position to said third position and when said actuator means is moved from said third position to said second position, and said roller drive means transmitting rotational motion to said drive wheel when said actuator means is moved from said second position to said third position and when said actuator means is moved from said third position to said second position.

19. A mop wringer system comprising a mop wringer and a mop, said mop wringer having:

a housing, a pair of rotatable, wringing rollers having resilient roller bodies, at least one of said rollers being movable between an inactive position in which said rollers are out of contact with one another and in spaced apart relation and an active position in which said rollers are in contact with one another and pressed aainst one another so as to cause said roller bodies to be deformed and to generate a wringing pressure between said roller bodies, and at least one of said rollers being provided with a drive wheel for receiving rotational motion for causing said rollers to rotate in opposite directions when in said active position, and actuator means movable from a first position, through a second position and to a third position, and comprising a first and a second cam surface and a roller drive means, said first cam surface guiding said movable roller from said inactive position to said active position, when said actuator means is moved from said first position to said second position, said second cam surface locking said movable roller in said second position, when said actuator means is moved from said second position to said third position and when said actuator means is moved from said third position to said second position, and said roller drive means transmitting rotational motion to said drive wheel when said actuator means is moved from said second position to said third position and when said actuator means is moved from said third position to said second position, and said mop having:

a mop body and two wing parts, which wing parts are hinged to one another at inner ends thereof, and said mop body being connected to said wing parts at outer, opposite ends of said wing parts, said mop being collapsible by swinging said wing parts from an operational position, in which said wing parts define a substantially plane surface against which said mop body is maintained in a stretched-out position, and an inoperational position, in which said wing parts are collapsed so as to allow said mop body to suspend from said opposite ends of said wing parts for introducing said mop body into said mop wringer.

* * * * *